US006119363A

United States Patent [19]

Bahner et al.

[11] Patent Number: 6,119,363

[45] Date of Patent: Sep. 19, 2000

[54] ROTARY DRUM FOR DRYING POURABLE GOODS

[75] Inventors: Karl-Friedrich Bahner, Rotenburg; Dagmar Bautzmann, Moers; Wolfgang Schröder, Krefeld, all of Germany

[73] Assignee: Buttner Gesellschaft fur Trocknungs-und Umwelttechnik GmbH, Krefeld, Germany

[21] Appl. No.: 09/242,181

[22] PCT Filed: Jul. 31, 1997

[86] PCT No.: PCT/EP97/04185

§ 371 Date: Apr. 29, 1999

§ 102(e) Date: Apr. 29, 1999

[87] PCT Pub. No.: WO98/06989

PCT Pub. Date: Feb. 19, 1998

[30] Foreign Application Priority Data

Aug. 8, 1996 [DE] Germany ..... 196 31 998

[51] Int. Cl.[7] ..... F26B 11/02

[52] U.S. Cl. ..... 34/135; 34/139; 34/142; 34/147; 34/183

[58] Field of Search ..... 34/135, 136, 139, 34/140, 141, 142, 147, 179, 180, 183; 366/25, 26, 147; 210/283, 290

[56] References Cited

U.S. PATENT DOCUMENTS

| | | | |
|---|---|---|---|
| 2,341,101 | 2/1944 | Howard . | |
| 2,483,630 | 10/1949 | Erisman | 34/135 |
| 2,840,922 | 7/1958 | Erisman et al. | 34/135 |
| 3,145,979 | 8/1964 | Madsen | 34/142 X |
| 3,950,861 | 4/1976 | Weimer et al. . | |
| 4,338,732 | 7/1982 | Coxhill | 34/135 |
| 4,566,376 | 1/1986 | Webb | 99/468 |
| 4,628,614 | 12/1986 | Thompson | 34/135 X |
| 5,157,849 | 10/1992 | Ronning . | |
| 5,197,204 | 3/1993 | Christensen | 34/135 |
| 5,305,533 | 4/1994 | Alexander et al. | 34/34 |

FOREIGN PATENT DOCUMENTS

| | | |
|---|---|---|
| 0 183 304 | 6/1986 | European Pat. Off. . |
| 626978 | 9/1927 | France . |
| 288 896 | 11/1915 | Germany . |
| 423 753 | 1/1926 | Germany . |
| 530 272 | 3/1929 | Germany . |
| 1230 703 | 10/1963 | Germany . |
| 18 04 154 | 4/1970 | Germany . |
| 23 62 725 | 6/1975 | Germany . |
| 29 11 137 | 3/1979 | Germany . |
| 175 71 | 10/1981 | Germany . |
| 33 45 118 | 2/1985 | Germany . |
| 351 130 | 6/1931 | United Kingdom . |
| WO 91 165 86 | 10/1991 | WIPO . |

*Primary Examiner*—Stephen Gravini
*Attorney, Agent, or Firm*—Herbert Dubno

[57] ABSTRACT

Directly heated rotary drums are used in the drying of pourable goods such as wood chips or strands. Drums are provided with built-in fixtures such as cross fixtures, in order to ensure good heat transmission from the drying gas to the goods. The invention comprises a design for a rotary drum (4) which enables good transmission of drying gas to the goods and which is cheap to produce and assemble in comparison with cross fixtures. According to the invention the built-in fixtures in the rotary drum (4) extend radially in the direction of the middle of the drum, starting from the perimeter, over an area of 60 to 85% of the radius of the rotary drum (4), form at least two pockets, and run, apart from the area close to the perimeter, substantially in the direction of rotation (25), in front of the radial starting from their point of attachment. These radially shaped built-in fixtures enable constant distribution of the goods over the cross-section and are substantially cheaper to manufacture and assemble.

11 Claims, 5 Drawing Sheets

ROTARY DRUM FOR DRYING POURABLE GOODS

CROSS REFERENCE TO RELATED APPLICATIONS

This application is a national stage of PCT/EP 97/04185 filed Jul. 31, 1997 and based, in turn, upon German National application 196 31 998.6 of Aug. 8, 1996 under the International Convention.

FIELD OF THE INVENTION

The invention relates to a rotary drum for the drying of i.e., flowable bulk materials.

BACKGROUND OF THE INVENTION

In the drying of pourable goods, especially in the drying of wood chips and strands, directly heated rotary drums are used. The bulk material and the drying gas are introduced at the inlet of the rotary drum and the dried bulk materials and the drying gas are withdrawn at the outlet.

To generate a good heat transfer from the drying gas to the bulk material, it is known from the book: K. Kröll "Trockner und Trocknungsverfahren", Springer-Verlag 1959, pages 475 to 479, to provide the rotary drums with baffles. The baffles serve to subdivide the bulk material into a number of masses to distribute the bulk material uniformly over the drum cross section, to provide a greater surface, and to allow the gas stream to pass through the bulk material repeatedly in a transverse manner. The there-described cross baffles have been used by the applicant frequently for the drying of wood chips.

Cross baffles are also known from DE-B 23 62 725 and DE-B 29 11 137. They are not well suited for the drying of strands, wood pieces of widths of 5 to 50 mm and lengths of 75 to 150 mm, from which oriented strand board (OSB) is fabricated. A rotary drum having closely-spaced cross baffles like those used for the drying of wood chips can be easily used for the drying of strands. If one increases the spacing of the cross baffles, the heat transfer from the drying gas to the bulk material becomes too small. Apart from this, they have the disadvantage of relatively high fabrication and assembly costs.

Baffles for bulk materials are additionally described for a rotary drum in DE-B 18 04 154. These baffles for bulk material have radially extending cell walls which are partly permeable and which subdivide the cross section of the drum into equal sectors which interconnect via openings with one another. The cell walls are formed with ribs on their sides which face rearwardly with respect to the sense of the drum rotation and which extend approximately perpendicularly from the walls and run parallel to the drum axis. In addition, on the inner periphery of each sector, a lifting scoop rib is provided. With this arrangement, the bulk material trickle from the baffles of each sector over a uniform time. At the last part of the drum rotation, however, the sectors are only partly filled. The distribution of the bulk material over the cross section of the drum is nonuniform. Within a sector, at least with drums of large cross section, there may be excessive free fall stretches in which the bulk material can be entrained by the drying gas. If the openings in cell walls are selected so that they are too large, this effect is increased while if the openings are chosen to be too small, there is a danger of plugging up.

From DE-C 33 45 118, a generic device for the drying of sugar with a rotary tube is known. The rotary tube is provided along its inner periphery with a multiplicity of peripheral sets of outer scoops uniformly distributed in a ring shape. All outer scoops of one peripheral set extend in the axial direction over a certain length of the rotary tube. The outer scoops of peripheral sets located one after the other are offset from one another. At the center of the rotary tube a structure is fastened to the rotary tube with an elongated carrier which is formed on its external periphery with internal scoops in approximately a ray shape. These trickle baffles are not suitable for the drying of light wood chips and strands. The fall paths in the interior of the rotary tube are too great. In addition, the surfaces of the baffles in total is too small for an effective heat transfer.

OBJECT OF THE INVENTION

The object of the invention is to provide a rotary drum for the drying of pourable goods, i.e. flowable bulk materials according to the preamble of claim 1 which is suitable for the which is suitable for the enables a good heat transfer from the drying gas to the bulk material and whose fabrication and mounting cost is at least not higher than those for cross baffles.

SUMMARY OF THE INVENTION

The rotary drum according to the invention is especially suitable for the drying of wood chips, strands and chip materials with long chips, but is also suitable for the drying of other flowable matter.

According to the invention, the baffles extend, starting from the periphery, in the direction of the drum center, ray-like over a major portion of the drum radius. This portion amounts to at least 60% and at least 85% of the drum radius. By comparison to cross baffles, ray-shaped baffles can be fabricated somewhat more economically. Instead of producing cross baffles by welding, ray-shaped baffles can be fabricated for example from tilted sheet. The ray-shaped baffles can, when they are composed of a single piece, be affixed only at the periphery of the rotary drum. They can also be constituted of two parts, whereby the outer part is affixed to the periphery of the rotary drum while the inner part is secured at the interior, for example, on an inner tube. In both cases, the mounting is simpler than with cross baffles.

With the ray-shaped baffles, the product is divided into multiple partial masses. The baffles extend over 60 to 85% of the drum radius and thus ensure a large baffle area. The greater the baffle area, the more the surface of the bulk material and the residence time of the product in the rotary drum can be increased and thus the greater will be the heat transfer. With ray-shaped baffles there is also a more rapid distribution uniformly of the product over the drum cross section than is the case with cross baffles.

The coarser the product to be dried, the smaller is the number of ray-shaped baffles. For similar drum cross sections, the number of ray-shaped baffles in the drying of strands can amount to only 0.5 to 0.8 times the number required for the drying of wood chips.

The ray-shaped baffles form, as they extend from the periphery toward the drum center, at least two pockets. One pocket is formed from two sections of the ray-shaped baffle oriented to one another for example at 90° and forming an opening angle which opens in the direction of rotation. The first section of a pocket can be arranged mainly radially. To the second section for the first pocket, there is connected either directly in the case of a one-piece ray-shaped baffle, or via a small intermediate compartment, for example bridged by a guide plate, the first section of the second pocket. To the second or, in the case of a multiplicity of pockets, to the last pocket, a further section can be connected. The configuration with pockets and a further section, results in a cascade shape configuration of the ray-shaped baffles. Via the pockets, the product is further subdivided and, upon trickling out of the pockets during the rotary movement, is distributed over the drum cross section. They reduce the free fall stretches and ensure that the product will be circulated and loosened.

The ray-shaped baffles extend initially along a radius from their attachment points on the periphery and are offset by the configurations of the pockets, ahead of the radius. If the drum cross section is subdivided into sectors by the fastening points, the ray-shaped baffles tend to stretch in their paths toward the drum center over at least half of their respective sector ahead of the radius. Especially with a large number of ray-shaped baffles, they can extend over the entire sector and project toward the drum center into the next sector. This ensures that in the travel of the ray-shaped baffles their pockets will be emptied in succession by trickling of the product from the pockets even, especially in that half of the drum cross section which is rearwardly with respect to the rotation direction. The baffles extend into the region of the drum center and there form at last two pockets with the configuration of the ray-shaped baffles in the respective sector such as to enable a homogeneous distribution of the flowable product over the drum cross section, a large drying area on this and good heat transfer from drying gas to the product. One piece ray-shaped baffles formed from built-in sheet metal are structurally simple and thus simple to fabricate and to mount. For stabilization the built-in sheets of one set are connected with one another at one or more locations lying one behind the other along the drum axis, for example at three locations, one at the periphery, one at the center and one in an end region by circular connecting pieces.

These connecting pieces serve to break up accumulations of longer strands of low density which can form in the drying operation and separate particles of the product which tend to adhere together. The connecting pieces which are especially suitable are tube sections of round diameter.

The arrangement of one or more rings, for example at the beginning, the middle and the end of a set and to which the ends of all ray-shaped baffles or the ends of parts of equal length are affixed, serves for further stabilization. The lifting scoops which are additionally arranged between the ray-shaped baffles effect a further subdivision of the product and an improvement in the distribution of the pourable product over the cross section. The lifting scoops are disposed at a slightly positive and at a negative angle to the radius and are planar or angled in the direction of rotation.

An offsetting of the ray-shaped baffles in sets arranged behind one another, for example, over half the sector widths, gives rise to a layering of the product which increases the residence time and contributes to improvement of the heat transfer.

Ahead of or behind a set or behind sets of the ray-shaped baffles, zones are formed with curved lifting scoops and, lifting scoops angled in the direction of rotation and whose lengths amount to about 20% of the length of the ray-shaped baffles of a set to avoid blockages at the transitions from one to another set.

The arrangement of constricting disks ahead of or behind a set of ray-shaped baffles, whereby a constricting disk is configured as a round, central disk or as an intermediate or outer ring, increases the residence time by restricting the movement of the product.

With different types of ray-shaped baffles with different lengths or in different numbers, with different shapes and a different arrangement of the pockets, the flow of the product from the pockets can be varied still more strongly. The emptying of the different pockets can be better timed with respect to one another so that the distribution of the product flowing through the cross section becomes more homogeneous.

Baffles with different lengths, whereby a part of the baffles extend more closely to the center of the drum than is customary, has the advantage that the product can be uniformly distributed also at the center of the drum without the danger of blockage.

The opening angles of the pockets of 70 to 140 grad, orientation angles of the pockets from 10 to −30 grad to the radii and orientation angles with the radius defined by the upper edges of the first sections and the first sections of the pocket, and signs of the orientation angle with respect to the direction of rotation, and heights and widths of the pocket which are established by the lengths of the first and second sections, enable a homogeneous distribution of the bulk material flowing through the cross section.

BRIEF DESCRIPTION OF THE DRAWING

FIGS. 2, 4, 5 and 6 are cross sections taken along lines III—III, IV—IV, V—V, VI—VI respectively through the rotary drum of FIG. 2;

SPECIFIC DESCRIPTION

Figure 1:
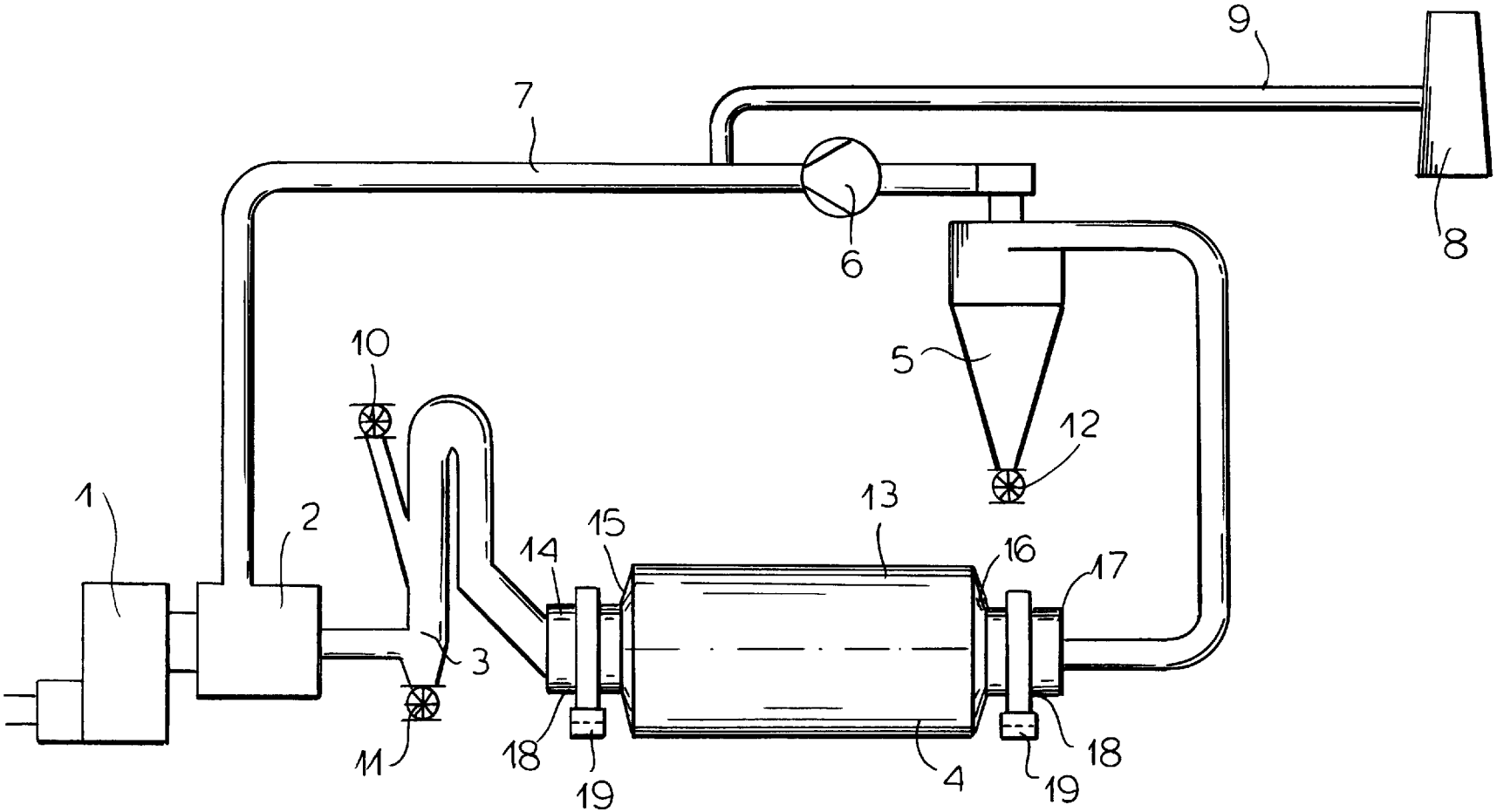
FIG. 1 has a flow diagram of an apparatus for drying wood chips or strands.

An apparatus for drying wood chips or strands has, connected one after the other by ducts, a combination chamber 1, a mixing chamber 2, a flow tube 3, a rotary drum 4 and a cyclone 5. From cyclone 5 (FIG. 1) a return gas line 7 with a blower 6 is connected to the mixing chamber 2. Downstream of the blower 6 a duct 9 is branched from the return gas line 7 to a chimney 8. In FIG. 1 a wet product supply is provided at 10 and a coarse product gate at 11, both along the flow tube 3 and a dry product discharge is provided at 12 on the cyclone 5.

The rotary drum 4 is subdivided into an inlet part, a middle part 13 and an outlet part whereby the inlet has a first part 14 with a diameter smaller than the drum diameter of the middle part 13 and a second conically widening part 15. The outlet is provided with a first conically narrowing part 16 and a second part 17 with a smaller diameter.

The parts 14 and 17 of smaller diameter of the inlet and the outlet have running rings 18 supported by the bearings 19 engage. A bearing 19 has for example bearing elements of a roller bearing.

The rotary drum 4 can also be formed without the conically widening or conically narrowing parts 15, 16. At the ends of the rotary drum 4, a discharge housing can be provided for the dried product.

The rotary drum 4 is arranged horizontally in the Examples 1 and 2. It can also be inclined in the feed direction.

In operation, the product to be dried is fed into flow tube 3 through the wet feeder 10. The product is predried in the flow tube with drying gases stemming from the combustion chamber 1 and mixed with recycled vapor in the mixing chamber 2. The product is dried to its final mixture content in the rotary drum which is it driven for example at 1 to 10 revolutions per minute.

The dried product is discharged in the cyclone 5. A part of the vapors is recycled to the mixing chamber 2, the balance leaving the apparatus, optionally after cleaning, through the chimney 8. The apparatus can be formed without the flow tube 3 especially for the drying of strands.

EXAMPLE 1 (FIGS. 2 to 6)

A rotary drum 4 for the drying of strands has at its inlet a double wall 20 and in the inlet and outlet, distributed over the peripheries thereof, baffles 21, 22 formed as lifting and transport scoops, whereby baffles 21 are slightly screw-shaped in the second part 15 of the inlet. The rotary drum 4 can also have a simple shell.

In the interior of the middle part 13 the rotary drum 4 is provided with at least one set 23 of baffles distributed over the periphery and extending in the direction of the drum axis 24. The baffles of the one set 23 extend, starting from the periphery of the rotary drum 4, ray-shaped in the direction of the drum center. The region over which the baffles extend can amount to 60 to 85% of the drum radius. The ray-shaped baffles extend beyond the neighborhood of the periphery substantially in the direction of rotation 25 ahead of the radius at the fastening point 26 on the periphery and form in running from the periphery to the drum center at least two pockets.

The ray-shaped baffles are each comprised of a built in sheet whose axial length corresponds to the length of the one set 23. In this example, a total of 12 built in sheets are provided in a cascade shape and consist of six each of two different types A and B alternatingly distributed around the periphery. The baffle sheets of type A are longer and form more pockets than those of type B.

The baffles of type A form over their extent, three pockets and stretch over a region of 75% of the drum axis. For that purpose, the baffle of Type A is subdivided into angularly adjoining sections 27, 28, 29, 30, 31, 32 and 33, whereby the built in sheet is fastened with the section 27 at the periphery and extends with the last section 33 into the drum center. The sections 27 and 28 on the first pocket form the first and second sections of the first pocket, segments 29 and 30 form the second section of the second pocket and segments 31 and 32 form the first and second sections of the third pocket. The baffle sheets of type B over their extent toward the center of the drum form two pockets and extend over a region of 64% of the drum radius. The built-in sheet of type B is subdivided into five segments 34, 35, 36,37 and 38, whereby the built-in sheet is fastened at the periphery with the segments 34 and has its last segment 38 extending to the drum center. The segments 34 and 35 form the first and second sections of the first pocket and the segments 36 and 37 form the first and second sections of the second pocket.

The opening angle of the pockets amounts to 70 to 140 grad. The opening angle of the pockets of the type A baffles differ only slightly and lie in the vicinity of 90 grad. The pockets of the type B baffle differ more greatly and at least one opening angle is greater than 100 grad.

The baffles are so formed that the pockets have an orientation angle of 10 grad to −30 grad to the radius referred to the direction of rotation, whereby inwardly lying pockets have a more negative orientation angle. When the opening angle of the pockets of a baffle like a type A differ less, the orientation angle of the pockets from the exterior to the interior are always more negative. Lengths of the first sections of the pockets amounts to 0.15 to 0.25 times the drum radius and the lengths of the second sections of the pockets amounts to 0.05 to 0.15 times the drum radius.

The three pockets of the type A baffle have opening angles of 95 grad, 90 grad and 90 grad and are arranged with orientation angles of 0 grad, −7 grad and −13 grad. Lengths of their first sections 27, 29, 31 are each 0.21 times the drum radius and the lengths of their second sections 28, 30, 32 is 0.13 times, 0.1 times and 0.05 times the drum radius. The last section 33 of the baffle is arranged at an orientation angle of −20 grad. Its length amounts to 0.11 times the drum radius.

The two pockets of the type B baffle have opening angles of 95 grad and 118 grad and are disposed at orientation angles of 0 grad and −7 grad. The lengths of their first sections are 0.21 times and 0.15 times the drum radius and lengths of their second sections are each 0.13 times the drum radius. The last section 38 is oriented at an angle of 2 grad. Its length amounts to 0.11 times the drum radius.

With this configuration of the baffles of types A and B, each baffle begins with a stretch running along the radius through the fastening point 26 and then has a pocket configuration ahead of the radius. If the drum cross section is divided into 12 sectors, delimited by their fastening points 26, the baffle sheets on their way to the drum center extend two-thirds of a sector in the case of the type A baffle and half of this sector in the case of a type B baffle ahead of the respective radius.

The baffle plates of one set 23 are affixed at three locations, namely, at a location in the feed direction 39 at the periphery, in the middle and in the end region of the set 23 by circular connecting pieces 40 with one another. As connecting pieces 40, tube sections of round cross section can be used. The connecting sections 40 are arranged at a spacing of 40 to 60% of the drum radius from the drum axis within the outer two pockets of the baffles. In this example they are arranged in the vicinity of the second pockets of the type A and type B baffles at half the drum radius.

The set 23 has in addition, centrally at the beginning, in the middle and at the end of the set 23, rings 41 at which the ends of the segments 33 of the longer type A baffles are secured. The radius of the rings 41 depends upon the lengths of the baffles to which they are affixed and is 25 to 30% of the drum radius.

Between the baffles built into the drum at an orientation angle of for example −9 grad, there are 12 straight lifting scoops 42.

In FIGS. 2 to 6 peripheral rings 43 are provided at each end of the set 23.

Figure 2:
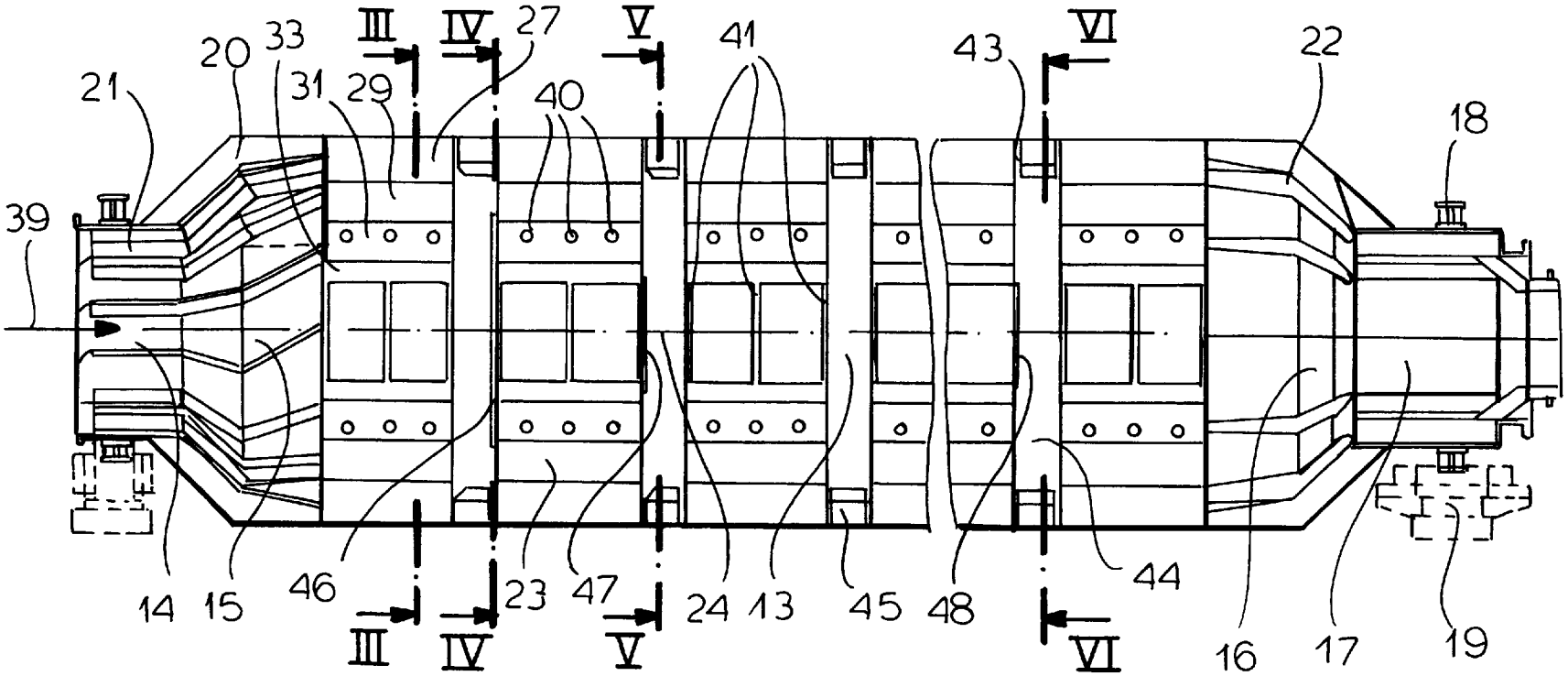
FIG. 2 is a broken away longitudinal section through a rotary drum for the drying of strands.
Figure 4:
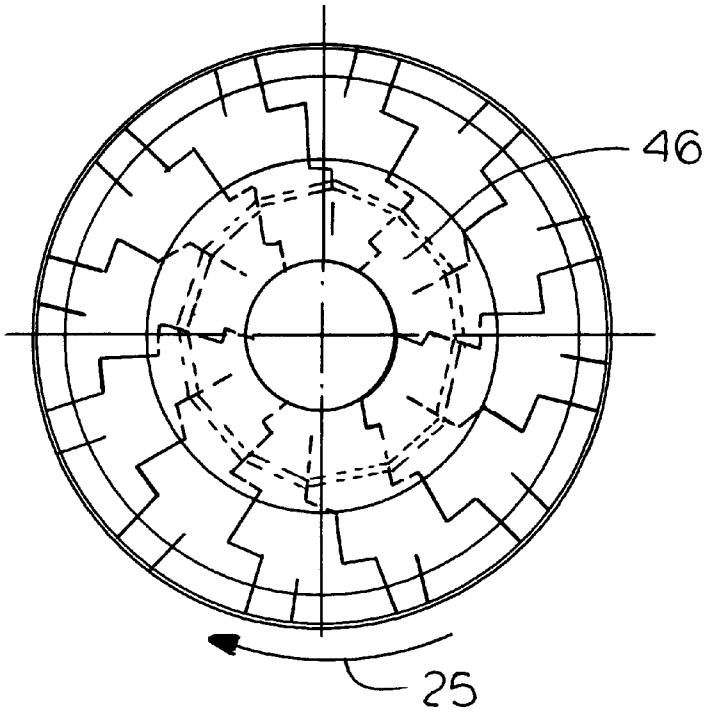
Figure 3:
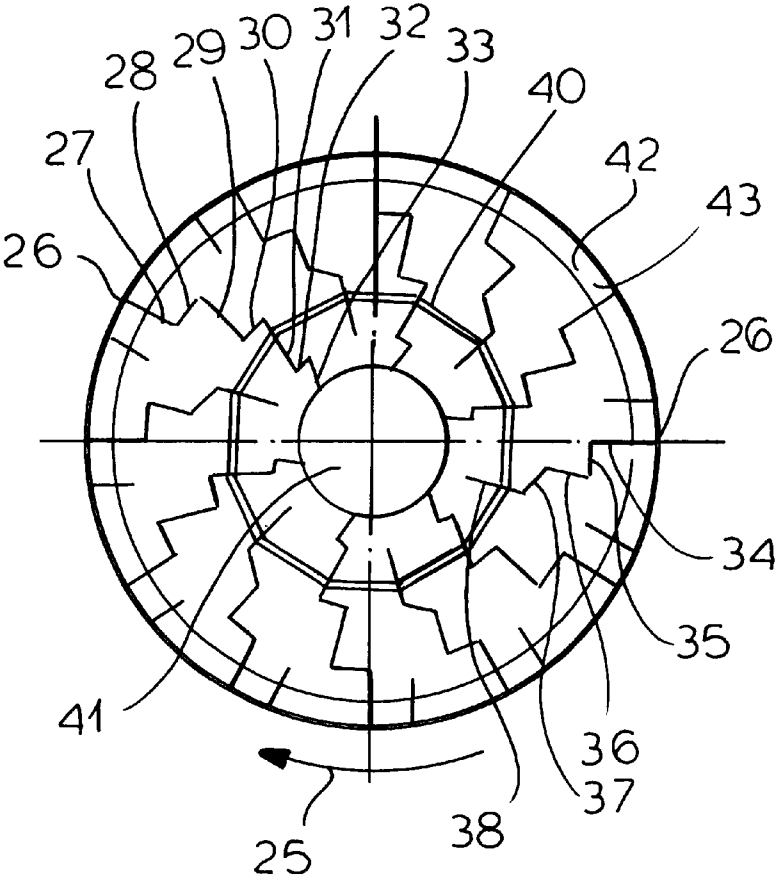
Figure 6:
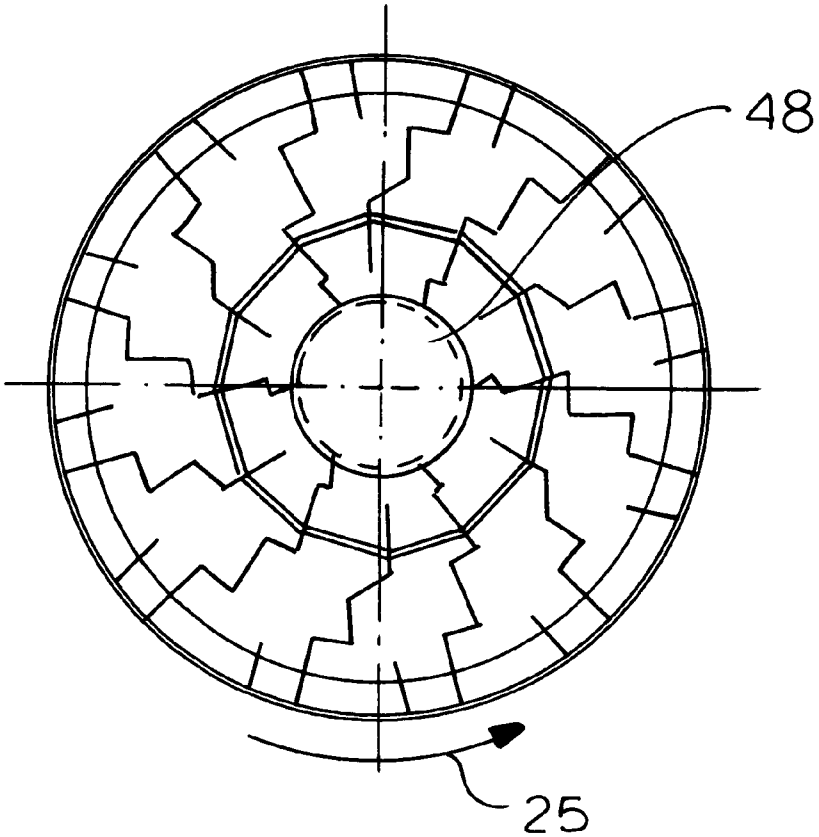
Figure 5:
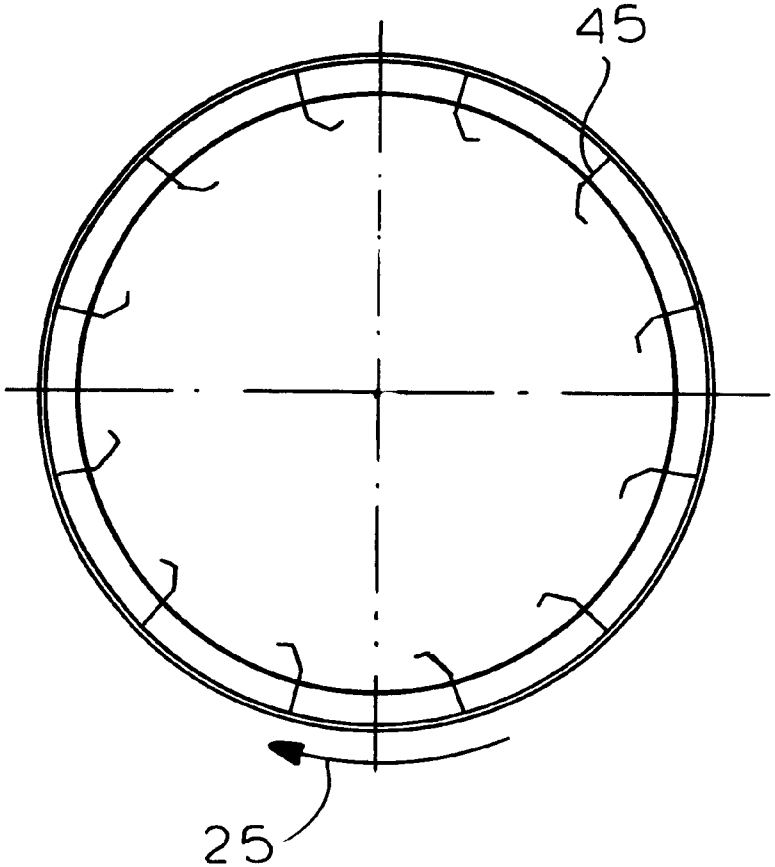
Figure 7:
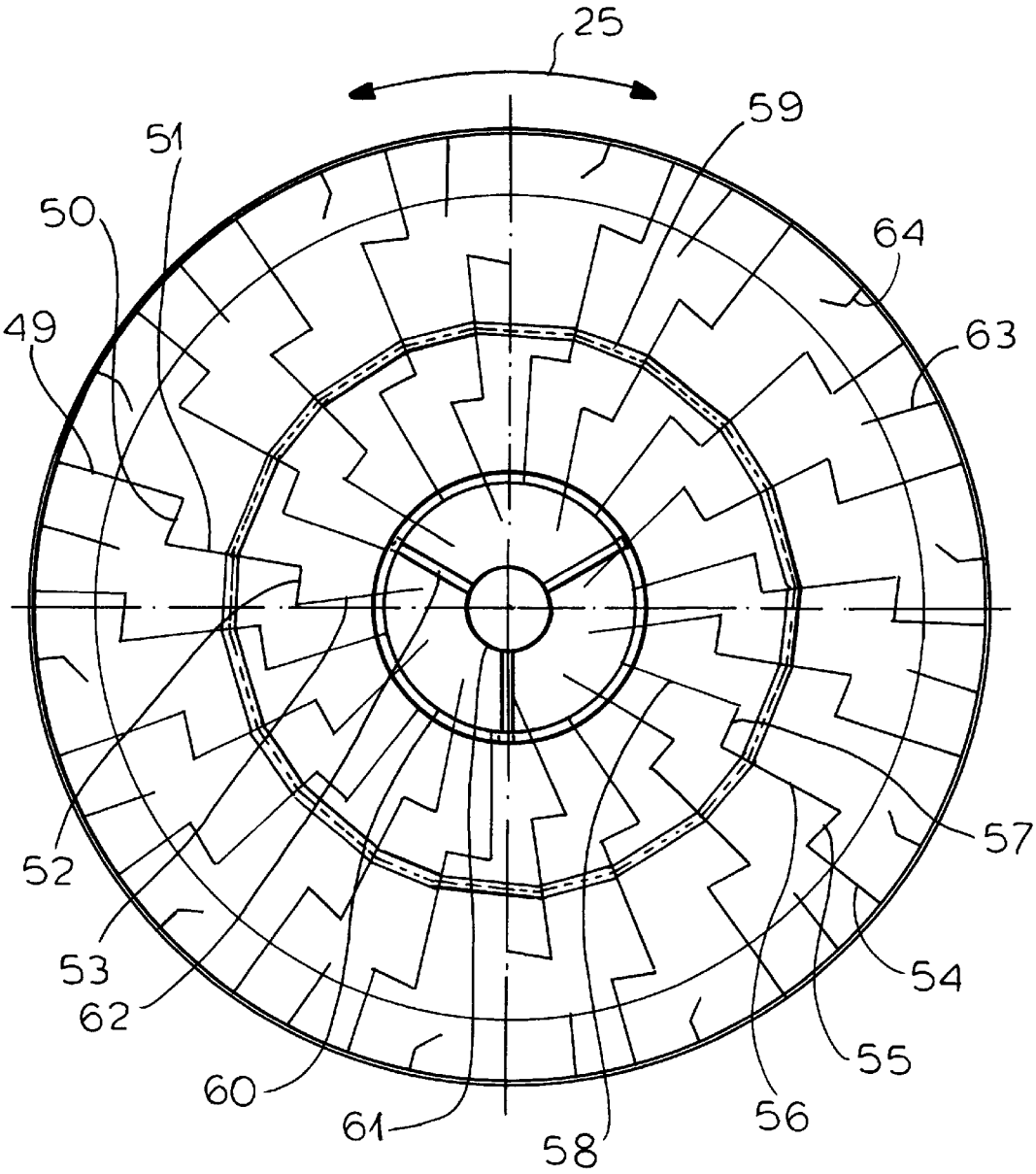
FIG. 7 is a cross section through another rotary drum according to the invention.

In the rotary drum 4 in the feed direction 39 there are eight sets 23 of ray-shaped baffles arranged one after the other and of which in FIG. 2 only five can be seen because of the break. The ray-shaped baffles, i.e. the build-in sheets of each following set 23 are offset from one another. As a comparison of FIGS. 3 and 4 will show, the built-in sheets of the second set 23 are rotated by half the sector width relative to those of the first set 23 about the drum axis 24. The built-in sheets 23 of the following set are also rotated with respect to those of the preceding set by half a sector width. Between the sets 23 there are zones 44 in which twelve curved circumferentially-spaced lifting scoops 45 are provided which are angled in the direction of rotation. The length of a zone 44 amounts to about 20% of the length of the set 23.

In the rotary drum 4 there are a total of three blocking [weir] disks 46, 47, 48 which are arranged so that one blocking disk 46 (FIG. 4) is located in a region between ring 41 and approximately the middle of the second pocket of the baffles which overlap the disk 46 and in the feed direction 39 ahead of the second set 23. The two central blocking disks 47 and 48 which overlap the intermediate region up to ring 41 are arranged behind the second and seventh set 23.

The arrangement of the blocking disks 46, 47, 48 in the rotary drum 4 can vary. In the first three sets 23 of a rotary drum there is however always one or more blocking disks. With rotary drums 4 of larger diameter, the blocking disks are disposed further forwardly than in drums of smaller diameter. The blocking disks can also be formed as outer rings.

In operation the product to be dried is moved by the baffles always transverse to the feed direction 39 and distributed homogeneously over the cross section and dried by contact with the drying gas. The offsetting of the baffle plates of different sets and the provision of the locking disks ensures a long residence time.

EXAMPLE 2 (FIG. 7)

A rotary drum 4 of Example 2 for the drying of wood chips is constructed substantially like the rotary drum 4 of Example 1. It differs therefrom in that it has twenty baffle plates in cascade, ten each of types A and B. The baffle plates of type A are longer than those of type B and the baffle plates of type A can extend 82% of the drum radius inwardly while those of type B extend inwardly over a range of 73% of the drum radius. The baffle plates of both types A and B have, as they extend inwardly, two pockets each and are subdivided into five sections (49, 50, 51, 52, 53) (type A) and 54, 55, 56, 57, 58 (type B).

The two pockets of the baffle plates of type A are opening angles of 83 grad and 90 grad and are oriented with an orientation angle of 0 grad and 0.5 grad. The lengths of their first sections 49 and 51 amount to 0.27 times and 0.30 times the drum radius. The lengths of the second sections 50 and 52 correspond to 0.10 times 0.08 times the drum radius. The last section of the baffle is oriented at an orientation angle of −8 grad. Its length amounts to 0.28 times the drum radius.

The two pockets of the type B baffle plate have opening angles also of 83 grad and 90 grad and orientation angles of 0 grad and −2 grad. The lengths of their sections 54 and 56 amount to 0.19 times and 0.30 times the drum radius and the lengths of the second sections 54 and 57 correspond to 0.10 times and 0.09 times the drum radius. The last section 38 is at an orientation angle of 5 grad its length amounts to 0.27 times the drum radius.

In this example the opening angles of the pockets of both types A and b are the same and in the region of 90 grad with the longer baffle sheets of type A, the second pockets thereof are closer to the drum axis 24 than those of type B.

Connecting pieces 59 are outside the second sections 52 and 57 of the second pockets of the baffles at a spacing of about 60% of the drum radius from the drum axis 24.

By contrast to Example 1, the ends of the last section 38 of the third type B baffles are affixed on rings 60.

In addition each set 23 has a respective inner pipe 21 which is connected by struts 62 with rings 60.

The baffle plates of type A extend over the entire sector ahead of their respective radii and those of type B extend ahead of their respective radii over about two-thirds of the sector.

Alternately betweens the baffles there are two types C and D of lifting scoops 63, 64 whereby the scoops 63 of type C are flat and those of type D are angled in the feed direction.

In operation the wood chips are distributed during the drying by the baffles ever more uniformly over the cross section of the rotary drum.

What is claimed is:

1. A rotary drum for the drying of pourable products with at least one set of baffles distributed around an interior of the rotary drum and extending in an axial direction, the baffles starting at a periphery of the drum and extending in ray-shape in a direction of a drum center over a length of 60 to 85% of a radius of the rotary drum, said baffles forming at least two pockets and relatively a region at which each baffle is connected at the periphery projecting ahead of the respective radius in a direction of rotation from a respective fastening point.

2. The apparatus according to claim 1 wherein the ray-shaped baffles are each comprised of a built-in thin sheet, whereby the built-in sheets of one set are connected together at one or more locations by circular connecting pieces.

3. The apparatus according to claim 1 wherein at least a part of the baffle plates of one set are fastened at one or more locations at their inner ends.

4. The apparatus according to claim 1 wherein between the ray-shaped baffles, lifting scoops are arranged.

5. The apparatus according to claim 1 in which a plurality of sets of ray-shaped baffles are arranged one after another, the ray-shaped baffles of mutually following sets are offset from one another.

6. The apparatus according to claim 5 wherein the rotary drum has ahead or behind a set or between sets of ray-shaped baffles, zones with curved lifting scoops (45).

7. The apparatus according to claim 5 wherein ahead of or behind a set of ray-shaped baffles, blocking disks are arranged.

8. The apparatus according to claim 1 wherein alternatingly two types of ray-shaped baffles are provided whereby the two types differ in one or more of the features: length of the baffles, number, shape or arrangement of the pockets.

9. The apparatus according to claim 1 wherein the pockets have opening angles of 70 to 140 grad.

10. The apparatus according to claim 1 wherein the pockets are arranged with orientation angles of 10 to −30 grad to the radius with respect to the direction of rotation.

11. The apparatus according to claim 1 wherein the lengths of first sections of the pockets amounts to 0.15 to 0.25 times the drum radius and the lengths of second sections of the pockets amounts to 0.05 to 0.15 times the drum radius.

* * * * *